US010710834B2

(12) United States Patent
Hidaka et al.

(10) Patent No.: US 10,710,834 B2
(45) Date of Patent: Jul. 14, 2020

(54) FOLDING APPARATUS AND IMAGE FORMING SYSTEM INCORPORATING THE SAME

(71) Applicants: Makoto Hidaka, Tokyo (JP); Shinji Asami, Tokyo (JP); Tomohiro Furuhashi, Kanagawa (JP); Takuya Morinaga, Tokyo (JP); Tomomichi Hoshino, Kanagawa (JP); Yohsuke Haraguchi, Kanagawa (JP); Koki Sakano, Kanagawa (JP); Michitaka Suzuki, Kanagawa (JP); Akira Kunieda, Tokyo (JP); Fumiharu Yoneyama, Kanagawa (JP)

(72) Inventors: Makoto Hidaka, Tokyo (JP); Shinji Asami, Tokyo (JP); Tomohiro Furuhashi, Kanagawa (JP); Takuya Morinaga, Tokyo (JP); Tomomichi Hoshino, Kanagawa (JP); Yohsuke Haraguchi, Kanagawa (JP); Koki Sakano, Kanagawa (JP); Michitaka Suzuki, Kanagawa (JP); Akira Kunieda, Tokyo (JP); Fumiharu Yoneyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/227,686

(22) Filed: Dec. 20, 2018

(65) Prior Publication Data

US 2019/0276263 A1 Sep. 12, 2019

(30) Foreign Application Priority Data

Mar. 12, 2018 (JP) ..... 2018-044592

(51) Int. Cl.
*B65H 45/16* (2006.01)
*B65H 43/00* (2006.01)
*B31F 1/00* (2006.01)

(52) U.S. Cl.
CPC ..... *B65H 45/16* (2013.01); *B65H 43/00* (2013.01); *B31F 1/0035* (2013.01);
(Continued)

(58) Field of Classification Search
CPC ..... B31F 1/0035; B65H 45/16; B65H 45/30; B65H 43/00; B65H 2701/13212; B65H 2301/5123; B65H 2301/51232
(Continued)

(56) References Cited

U.S. PATENT DOCUMENTS 8,251,359 B2 * 8/2012 Suzuki ..... B65H 45/18 270/45
8,505,901 B2 * 8/2013 Tsuno ..... B65H 45/18 270/32

(Continued)

FOREIGN PATENT DOCUMENTS

JP 2005-089140 4/2005
JP 2012-086957 5/2012
JP 2015-120596 7/2015

*Primary Examiner* — Leslie A Nicholson, III
(74) *Attorney, Agent, or Firm* — Harness, Dickey and Pierce, P.L.C.

(57) ABSTRACT

A folding apparatus includes a folding device to fold a sheet bundle, an additional folding device, a conveyer, and control circuitry. The additional folding device includes a pressure roller disposed downstream from the folding device in a sheet conveyance direction and configured to press the sheet bundle after the folding device folds the sheet bundle and a sheet support member disposed opposite the pressure roller via the sheet bundle. The conveyer conveys the sheet bundle to a position at which the additional folding device presses the sheet bundle and hold the sheet bundle at the position.
(Continued)

The control circuitry causes the additional folding device to perform additional folding processing on a first position of the sheet bundle, the conveyer to move the sheet bundle to a second position different from the first position, and the additional folding device to perform the additional folding processing at the second position again.

10 Claims, 13 Drawing Sheets

(52) U.S. Cl.
CPC ..... *B65H 2301/5123* (2013.01); *B65H 2301/51232* (2013.01); *B65H 2701/13212* (2013.01)

(58) Field of Classification Search
USPC ..... 270/32, 45
See application file for complete search history.

(56) References Cited

U.S. PATENT DOCUMENTS 9,555,998 B2 * 1/2017 Watanabe ..... B65H 9/006
9,637,342 B2 * 5/2017 Hari ..... B65H 37/06
9,994,414 B2 * 6/2018 Hari ..... B65H 45/30
10,105,968 B2 * 10/2018 Iwata ..... B41J 11/04
10,363,757 B2 * 7/2019 Iwata ..... B41J 11/04
2014/0203486 A1 7/2014 Sugiyama et al.
2014/0203487 A1 7/2014 Hoshino et al.
2014/0203488 A1 7/2014 Hidaka et al.
2014/0206516 A1 7/2014 Hata et al.
2014/0206517 A1 7/2014 Kikuchi et al.
2014/0206518 A1 7/2014 Hidaka et al.
2014/0206519 A1 7/2014 Hoshino et al.
2014/0213425 A1 7/2014 Sugiyama et al.
2014/0336031 A1 11/2014 Suzuki et al.
2014/0364295 A1 12/2014 Watanabe et al.
2015/0031520 A1 1/2015 Nakada et al.
2015/0225201 A1 8/2015 Watanabe et al.
2015/0266697 A1 9/2015 Saito et al.
2016/0060072 A1 3/2016 Watanabe et al.
2016/0068359 A1 3/2016 Suzuki et al.
2016/0114999 A1 4/2016 Suzuki et al.
2016/0115000 A1 4/2016 Sugiyama et al.
2018/0201466 A1 7/2018 Saito et al.
2018/0236744 A1 8/2018 Suzuki et al.
2018/0257900 A1 9/2018 Suzuki et al.

* cited by examiner

《TWO FOLDED SHEETS》 《THREE FOLDED SHEETS》

FOLDING APPARATUS AND IMAGE FORMING SYSTEM INCORPORATING THE SAME

CROSS-REFERENCE TO RELATED APPLICATIONS

This patent application is based on and claims priority pursuant to 35 U.S.C. § 119 to Japanese Patent Application No. 2018-044592, filed on Mar. 12, 2018 in the Japanese Patent Office, the entire disclosure of which is hereby incorporated by reference herein.

BACKGROUND

Technical Field

The present disclosure relates to a folding apparatus and an image forming system incorporating the folding apparatus.

Description of the Related Art

Techniques exist for putting a sharp crease in a bundle of sheets (of paper or the like) to reduce a height of a folded portion of the bundle, using a folding apparatus that receives a sheet on which an image is formed and performs folding such as Z-fold processing or three-fold processing. The sharp crease is to press the crease of the sheet once pressed, so-called additional folding, to reduce bulging and the height of the folded portion of the sheet.

SUMMARY

This specification describes an improved folding apparatus that includes a folding device configured to fold a sheet bundle, an additional folding device, a conveyer, and control circuitry. The additional folding device includes a pressure roller disposed downstream from the folding device in a sheet conveyance direction and configured to rotate along the sheet conveyance direction to press the sheet bundle after the folding device folds the sheet bundle, and a sheet support member disposed opposite the pressure roller via the sheet bundle. After the folding device folds the sheet bundle, the conveyer conveys the sheet bundle to a position at which the additional folding device presses the sheet bundle and holds the sheet bundle at the position. The control circuitry is configured to cause the additional folding device to perform additional folding processing on a first position of the sheet bundle, the conveyer to move the sheet bundle to a second position different from the first position, and the additional folding device to perform the additional folding processing at the second position again.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
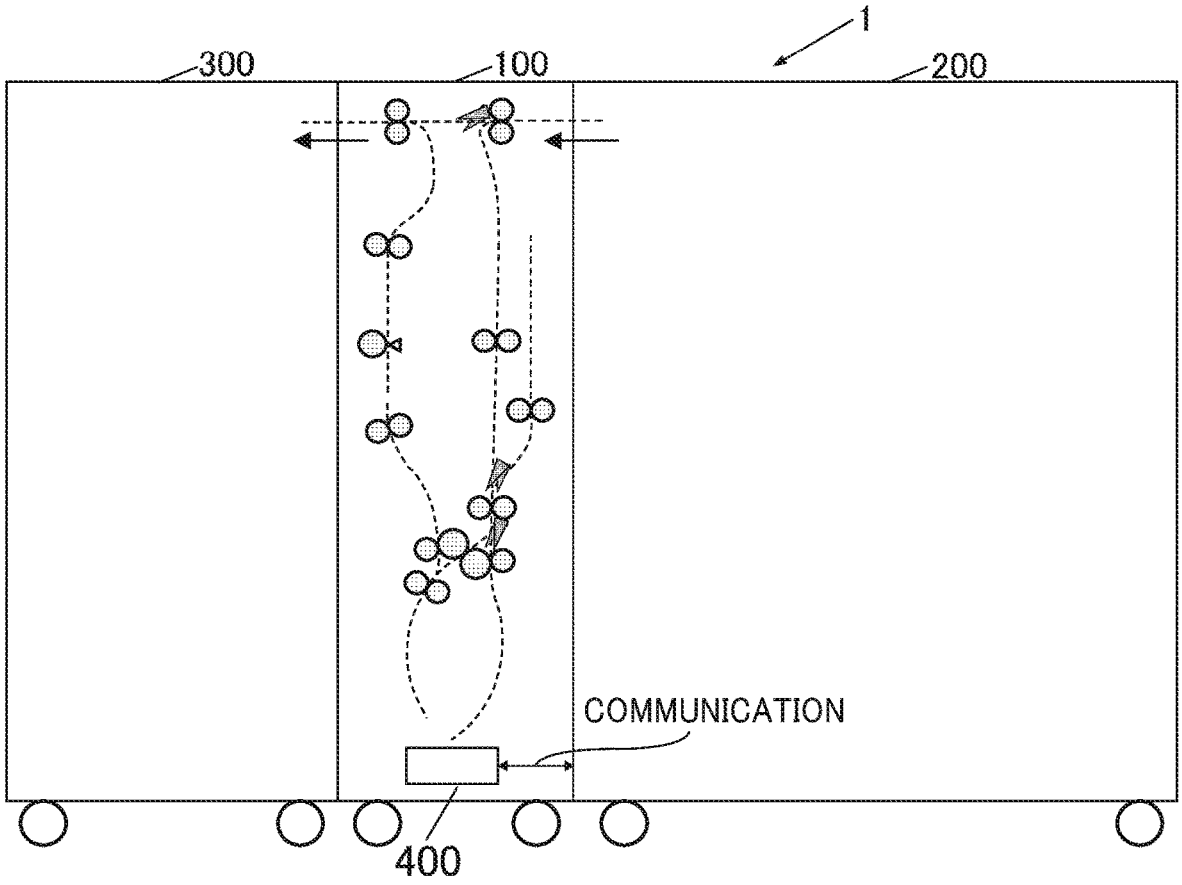
FIG. 1 is a diagram illustrating a schematic configuration of an image forming system including a folding apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

The folding apparatus according to the present embodiment folds the sheet on which an image is formed by an image forming apparatus. Note that the term "sheet" in this specification includes a sheet member such as a sheet of paper, a film, and a synthetic paper, although is not limited thereto.

In a folded sheet bundle, a position of a crease of a folded sheet gradually moves inside the folded sheet bundle as a position of the folded sheet moves inside the folded sheet bundle from outside the folded sheet bundle. The above-described difference in the position of the crease of the inner sheet in the folded sheet bundle causes a difference of effect that an additional folding processing by a roller reduces a height of a folded portion of the sheet bundle. The difference of the effect depends on a number of sheets and a pressing force position of the additional folding processing relative to the position of the crease of the inner sheet.

A feature of embodiments according to the present disclosure is a plurality of times of the additional folding processing for one folded portion of the sheet bundle including a plurality of folded portions of sheets. Therefore, a folding apparatus according to the present embodiment performs the additional folding processing a plurality of times and changes the pressing force position of the additional folding processing every time based on the number of sheets.

First Embodiment

FIG. 1 is a diagram illustrating a schematic configuration of an image forming system including the folding apparatus according to a first embodiment of the present disclosure. It is to be noted that identical or corresponding parts throughout the drawings described below are given identical reference characters and redundant descriptions are omitted.

In FIG. 1, the image forming system 1 includes a folding apparatus 100, an image forming apparatus 200, and a finisher 300. In the image forming system 1, the folding apparatus 100 is coupled behind the image forming apparatus 200, and the finisher 300 is coupled behind the folding apparatus 100, as illustrated in FIG. 1. The folding apparatus 100 receives the sheet on which the image is formed from the image forming apparatus 200 and performs folding.

The folding apparatus 100 includes control circuitry 400. The control circuitry 400 is circuitry that communicates with the image forming apparatus 200 and controls each section of the folding apparatus 100, which is described in detail later with reference to FIG. 5.

The finisher 300 performs such post-processing as stapling the sheet or the sheet bundle conveyed from the folding apparatus 100.

The image forming apparatus 200 has a copying function, a printing function, and the like. The copying function is a function of converting an image read by a scanner into image data, visualizing the image data, forming the image on the sheet, and outputting the image. The printing function is a function of forming an image on the sheet based on image data input from an external device such as a personal computer and outputting the image. These functions are gotten by using a known image forming method such as electrophotography, ink jet, or thermal transfer. In the present embodiment, the image forming method is not particularly limited.

Figure 2:
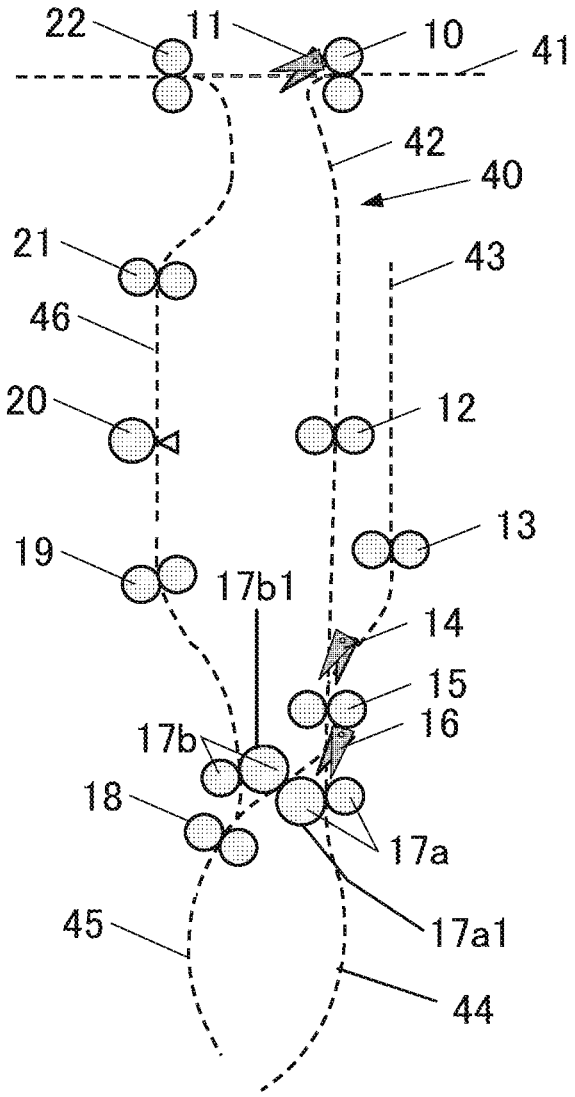
FIG. 2 is an explanatory diagram illustrating a schematic configuration of a conveyance path in the folding apparatus in FIG. 1.

FIG. 2 is an explanatory diagram illustrating a schematic configuration of a conveyance path 40 in the folding apparatus 100. In FIG. 2, the interior of the folding apparatus 100 in FIG. 1 is sectioned, and the conveyance path 40 is indicated by a broken line.

In FIG. 2, the conveyance path 40 includes first through sixth paths 41, 42, 43, 44, 45, and 46. The first path 41 is a path to directly convey the sheet from the image forming apparatus 200 to the finisher 300. The second path 42 branches downward from a first bifurcating claw 11 on the first path 41 and reaches a third bifurcating claw 16. The third path 43 is a path branching upward from a second bifurcating claw 14 disposed on the upstream side of the third bifurcating claw 16 on the second path 42. The fourth path 44 is a path extending from the third bifurcating claw 16 to the downstream side via a first folding roller pair 17*a*.

The fifth path 45 is a path extending downward from the third bifurcating claw 16 on the most downstream side of the second path 42 via a nip formed by a roller pair consisting of a roller 17*a*1 of the first folding roller pair 17*a* and a roller 17*b*1 of a second folding roller pair 17*b*. The sixth path 46 branches upward from the fifth path 45 and joins the first path 41. A fork from the fifth path 45 to the sixth path 46 is disposed between the roller pair 17*a*, 17*b*, and a third conveyance roller pair 18. A junction of the sixth path 46 and the first path 41 is at a position on the upstream side immediately before the nip of a sixth conveyance roller pair 22. In the conveyance path 40 configured as described above, the sheet conveyed along the second path 42 branching from the first path 41 on the downstream side of a first conveyance roller pair 10 is conveyed to the third to fifth paths 43, 44, and 45 based on how the sheet is folded. Thereafter, the sheet returns to the first path 41 via the sixth path 46 and is conveyed to the finisher 300.

On the first path 41, there are the first conveyance roller pair 10 on the upstream side of the fork of the second path 42 and the sixth conveyance roller pair 22 on the downstream side of the junction of the sixth path 46 and the first path 41. A pair of registration rollers 15 is disposed just before the upstream side of the third bifurcating claw 16 on the most downstream side of the second path 42 and the second bifurcating claw 14 is disposed on the upstream side the pair of registration rollers 15. A second conveyance roller pair 12 is disposed on the upstream side of the second bifurcating claw 14 on the second path 42 and in the intermediate portion between the second bifurcating claw 14 and the fork of the first path 41 and the second path 42. Furthermore, on the third path 43, an overlay roller pair 13 is disposed on the downstream side of the second bifurcating claw 14.

On the fourth path 44, the first folding roller pair 17*a* is disposed immediately downstream of the third bifurcating claw 16. On the fifth path 45, the roller pair consisting of the roller 17*a*1 of the first folding roller pair 17*a* and the roller 17*b*1 of the second folding roller pair 17*b* is disposed immediately downstream of the third bifurcating claw 16. On the fifth path 45, the third conveyance roller pair 18 is disposed on the downstream side of the roller pair consisting of the roller 17*a*1 and the roller 17*b*1, and the sixth path 46 branches between the third conveyance roller pair 18 and the roller pair consisting of the roller 17*a*1 and the roller 17*b*1.

On the sixth path 46, the second folding roller pair 17*b* is disposed immediately upstream of the fork of the fifth path 45 and the sixth path 46, and a fourth conveyance roller pair 19 and a fifth conveyance roller pair 21 are disposed downstream side of the second folding roller pair 17*b*. An additional folding roller 20 is disposed between the fourth conveyance roller pair 19 and the fifth conveyance roller pair 21. In this specification, the upstream side and the downstream side are determined by the direction in which the sheet is conveyed from the image forming apparatus 200 to the finisher 300.

In the folding apparatus 100 configured as illustrated in FIG. 2, the first conveyance roller pair 10 conveys the sheet received from the image forming apparatus 200 to the downstream side. When the sheet is folded, the first bifurcating claw 11 is driven to guide the sheet downward to the second path 42. When the sheet is not folded, the first bifurcating claw 11 is driven to guide the sheet to the first path 41, and the sheet is conveyed along the first path 41 to the left side in FIG. 2. The folding processing is performed using three nips formed by the first folding roller pair 17*a* and the second folding roller pair 17*b*. The sheet folded by the first folding roller pair 17*a* and the second folding roller pair 17*b* is conveyed upward in FIG. 2 along the sixth path 46. The additional folding roller 20 presses the folded sheet and put a sharp crease on the folded sheet, that is, performs the additional folding processing. Thereafter, the fifth conveyance roller pair 21 and the sixth conveyance roller pair 22 convey the folded sheet, and the folded sheet is output to the finisher 300 connected to the downstream side of the folding apparatus. When a plurality of sheets is overlaid and folded, the overlay roller pair 13 and the roller pair near the overlay roller pair 13 perform a sheet overlay operation before the folding processing.

FIGS. 3A to 3D are explanatory diagrams illustrating the sheet overlay operation.

Figure 3A:
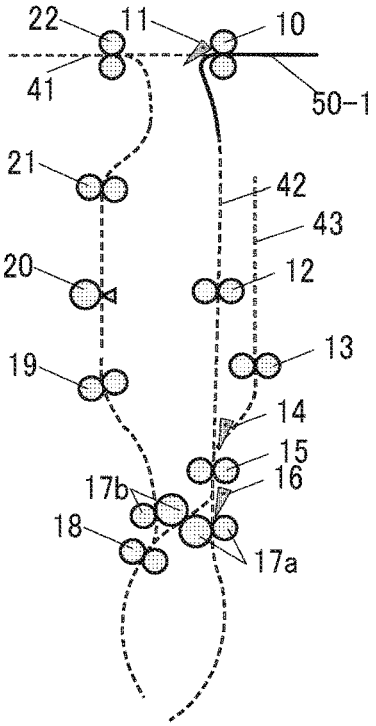
FIGS. 3A to 3D are explanatory diagrams illustrating a sheet overlay operation.
Figure 3B:
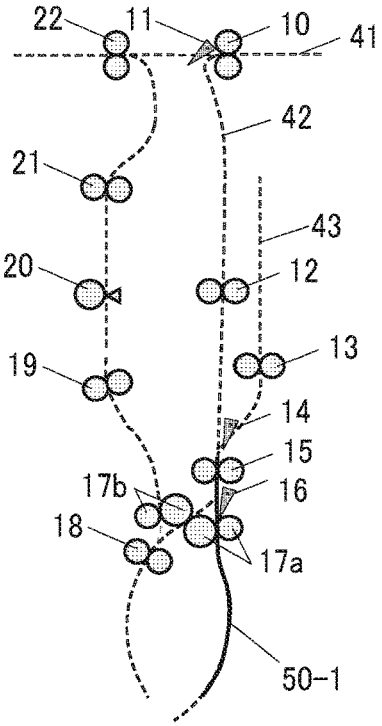
Figure 3C:
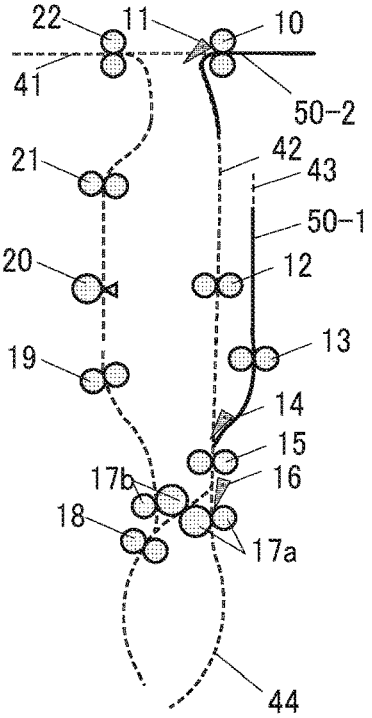

As illustrated in FIG. 3A, the first conveyance roller pair 10 and the first bifurcating claw 11 conveys a first sheet 50-1 conveyed along the first path 41 from the image forming apparatus 200 to the second path 42 to perform the folding processing. As illustrated in FIG. 3B, the third bifurcating claw 16 guides the first sheet 50-1 from the second path 42 to the fourth path 44. As illustrated in FIG. 3C, after a trailing edge of the first sheet 50-1 passes through the second bifurcating claw 14, the second bifurcating claw pivots, and the second conveyance roller pair 12 and the first folding roller pair 17*a* reversely rotate to convey the first sheet 50-1 in a reverse direction.

Figure 3D:
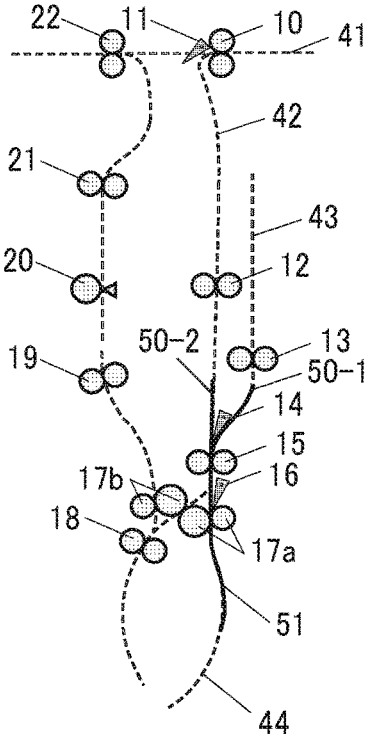

The overlay roller pair 13 conveys the first sheet 50-1 conveyed in the reverse direction into the third path 43 until the entire first sheet 50-1 pass through the pair of registration rollers 15. In this state, as illustrated in FIG. 3C, the second sheet 50-2 enters the second path 42. Next, as illustrated in FIG. 3D, when the leading edge of the second sheet 50-2 reaches the pair of registration rollers 15, the first sheet 50-1 is also conveyed to the fourth path 44, that is, downward in FIG. 3D, and, as a result, the first sheet 50-1 and the second sheet 50-2 are overlaid and conveyed. At this time, the control circuitry 400 sets the drive start timing of the overlay roller pair 13 based on the detection timing of a leading edge detection sensor disposed in the second path 42 immediately before the second bifurcating claw 14 to meet the leading edges of the two sheets 50-1 and 50-2 and send the two sheets to the fourth path 44. In this overlay operation, the two sheets 50-1 and 50-2 are conveyed and processed as one sheet bundle 51.

When three or more sheets are overlaid, the sheet bundle 51 including the overlaid two sheets is reversely conveyed again when the trailing edge of the sheet bundle 51 has passed through the second bifurcating claw 14 and enters the third path 43. Repeating the above operation according to the number of sheets to be overlaid makes it possible to overlay a desired number of sheets.

FIGS. 4A to 4D are explanatory diagrams illustrating Z-folding operation. Z-folding means folding a sheet or a sheet bundle in a Z shape.

At a timing to form a Z-folding portion at one quarter position of the sheet bundle from the trailing edge of the sheet bundle in a sheet conveyance direction, only the first folding roller pair 17*a* reversely rotates and conveys the sheet bundle 51 including sheets 50-1 and 50-2 performed the overlay operation as illustrated in FIG. 3D. This conveys an upstream portion of the sheet bundle 51 in the sheet conveyance direction from the fourth path 44 to the fifth path 45. At this time, the pair of registration rollers 15 also conveys a downstream portion of the sheet bundle 51 in the sheet conveyance direction to the side of the fifth path 45. As a result, the sheet bundle 51 receives the conveyance force from the both roller pairs 17*a* and 15 and bends at the upstream side from the nips of the roller pair consisting of the rollers 17*a*1 and 17*b*1. Further conveyance by the both roller pairs 17*a* and 15 from the above-described state pushes the bent portion of the sheet bundle 51 into the nip of the roller pair consisting of the rollers 17*a*1 and 17*b*1. Then, the nip of the roller pair consisting of the rollers 17*a*1 and 17*b*1 forms a first folded portion 51*a* of the Z shape with a crease at the quarter position of the sheet bundle 51 from the trailing edge of the sheet bundle 51 in the sheet conveyance direction.

Figure 4A:
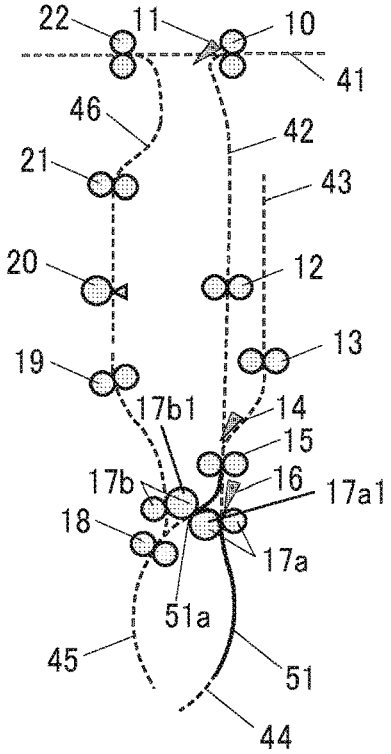
FIGS. 4A to 4D are explanatory diagrams illustrating a Z-folding operation.
Figure 4B:
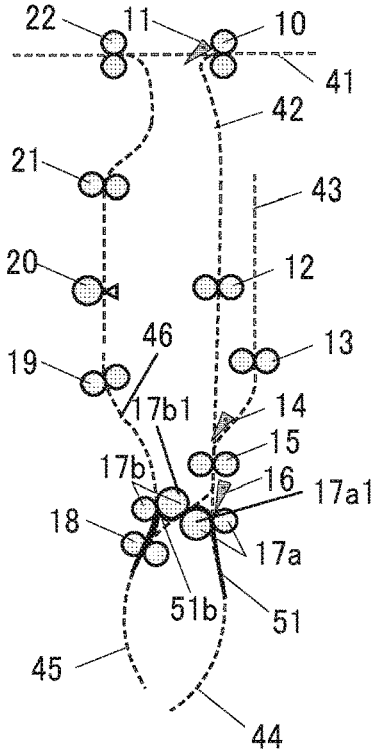

Subsequently, the roller pair consisting of the rollers 17*a*1 and 17*b*1 conveys the sheet bundle 51 formed the first folded portion 51*a* to the downstream of the fifth path 45, and the third conveyance roller pair 18 reversely rotates to form a second folded portion 51*b* at the half position of the sheet bundle 51 from the edge of the sheet bundle 51. As illustrated in FIG. 4B, this operation pushes the half position of the sheet bundle 51 into a nip of the second folding roller pair 17*b*, and the nip of the second folding roller pair 17*b* forms the second folded portion 51*b* to complete Z-folding.

Figure 4C:
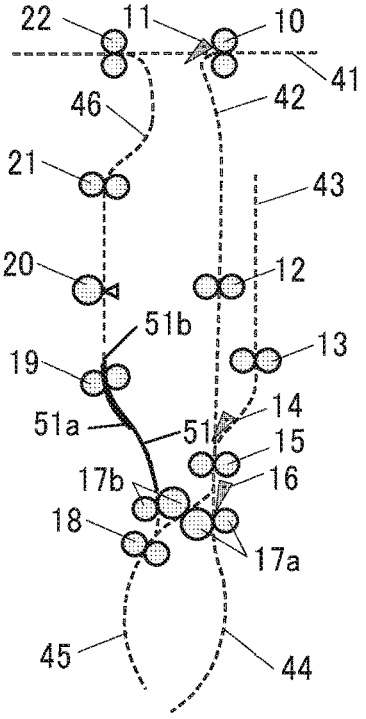
Figure 4D:
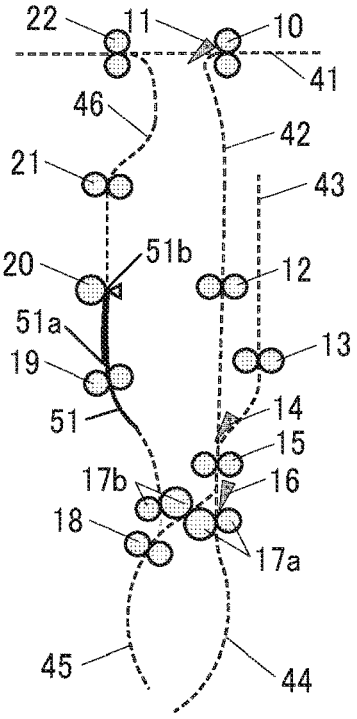

As illustrated in FIG. 4C, the second folding roller pair 17*b* conveys the Z-folded sheet bundle 51 to the sixth path 46, the fourth conveyance roller pair 19 conveys the sheet bundle 51 upward in FIG. 4C, that is, toward the downstream side in the sheet conveyance direction. As illustrated in FIG. 4D, the fourth conveyance roller pair 19 stops the conveyance of the sheet bundle 51 at a position of the additional folding roller 20, and the additional folding roller 20 rotates on the stopped sheet bundle 51 to put a sharp crease at the second folded portion 51*b*, that is, the additional folding processing is performed. Following additional folding processing at the second folded portion 51*b*, the sheet bundle 51 is further conveyed, and the additional folding processing at the first folded portion 51*a* is performed. The sheet bundle 51 in which the additional folding processing at the first folded portion 51*a* and the second folded portion 51*b* is performed is conveyed from the fifth conveyance roller pair 21 to the first path 41, and the sixth conveyance roller pair 22 conveys the sheet bundle 51 to the finisher 300.

In the description of FIG. 3 and FIG. 4, the sheet bundle 51 including the sheets 50 overlaid is folded. The additional folding processing for one sheet 50 is the same, but in this case, one sheet does not enter the third path 43 to await the following sheet.

Since the structure and the operation of the folding processing of the folding apparatus using a clamp and reverse method in which the two folding roller pair 17*a* and 17*b* described in the present embodiment are used to perform folding in two or three or the Z-folding are well known, their detailed description is omitted.

Figure 5:
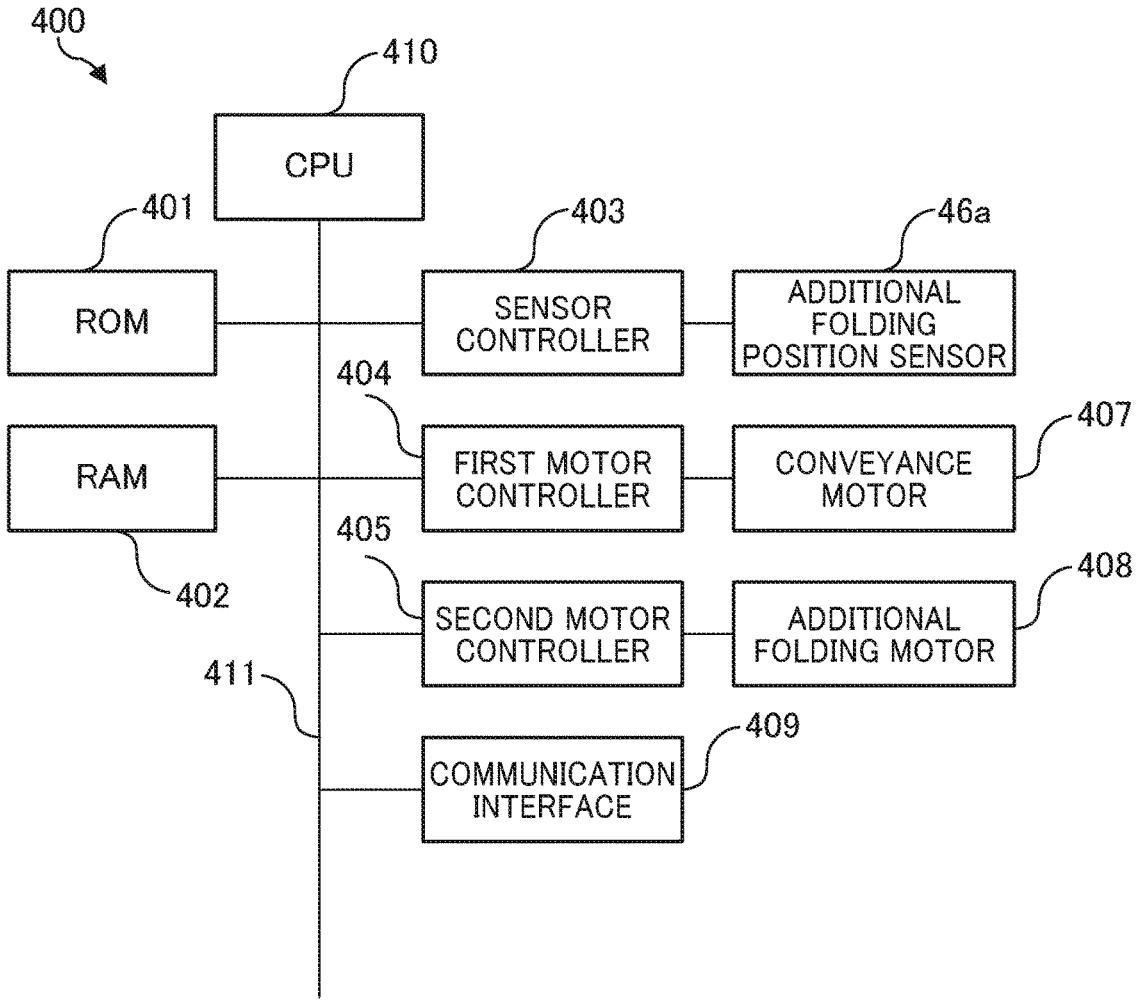
FIG. 5 is a block diagram illustrating control circuitry in the folding apparatus.

FIG. 5 is a block diagram illustrating the control circuitry 400 in the folding apparatus 100 according to the present embodiment. With reference to FIG. 5, the control circuitry 400 in the folding apparatus 100 includes a Central Processing Unit (CPU) 410, a Read Only Memory (ROM) 401, a Random-Access Memory (RAM) 402, a sensor controller 403, a first motor controller 404, a second motor controller 405, and a communication interface 409. These components are mutually electrically coupled via a bus line 411 such as an address bus and a data bus.

The communication interface 409 communicates with the image forming apparatus 200 and the finisher 300 which are illustrated in FIG. 1 and exchanges data necessary for control. The sensor controller 403 is connected to an additional folding position sensor 46*a* and monitors the sheet 50 moving along the conveyance path 40. The first motor controller 404 controls a conveyance motor 407 that drives the first to sixth conveyance roller pairs 10, 12, 18, 19, 21, and 22. The second motor controller 405 controls an additional folding motor 408 that rotates the additional folding roller 20.

The CPU 410 controls the folding apparatus 100 by executing a computer readable program stored in the ROM 401. The ROM 401 stores data and programs executed by the CPU 410. The RAM 402 temporarily stores data when the CPU 410 executes the program.

Figure 6:
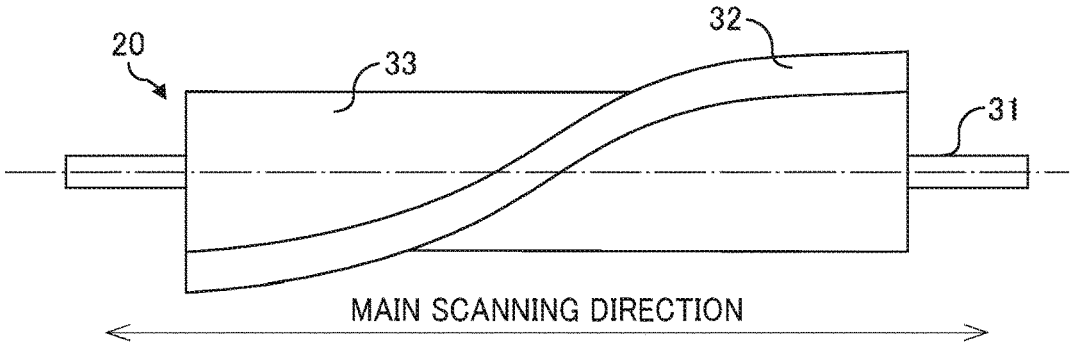
FIG. 6 is a front view illustrating the additional folding roller in the main scanning direction.
Figure 7:
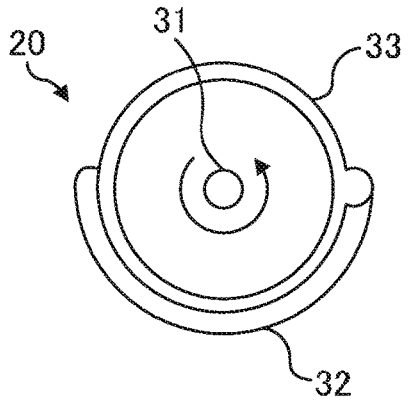
FIG. 7 is a side view illustrating the additional folding roller in the sub-scanning direction, that is, the view of the additional folding roller rotated by 90 degrees from the state of FIG. 6.

FIG. 6 is a front view illustrating the additional folding roller 20 in the main scanning direction, and FIG. 7 is a side view illustrating the additional folding roller 20 in the sub-scanning direction, that is, a view of the additional folding roller rotated by 90 degrees from the state of FIG. 6.

With reference to FIG. 6 and FIG. 7, the additional folding roller 20 includes a pressing force transmission roller 33 and a pressing force transmission portion 32. The pressing force transmission roller 33 is a roller that rotates about the roller rotation shaft 31. The pressing force transmission portion 32 is a ridge spirally formed on the surface of the pressing force transmission roller 33. That is, the pressing force transmission portion 32 is arranged as a ridge projecting a predetermined amount on the surface of the pressing force transmission roller 33 with a certain angle difference from the roller rotation shaft 31. As a result, the pressing force transmission portion 32 has a spiral convex portion on the outer peripheral surface of the pressing force transmission roller 33 along the roller rotation shaft 31. As illustrated in FIG. 7, the pressing force transmission portion 32 according to the present embodiment is disposed not on the entire outer peripheral surface of the pressing force transmission roller 33 but on about half of the outer peripheral surface of the pressing force transmission roller 33.

Figure 8A:
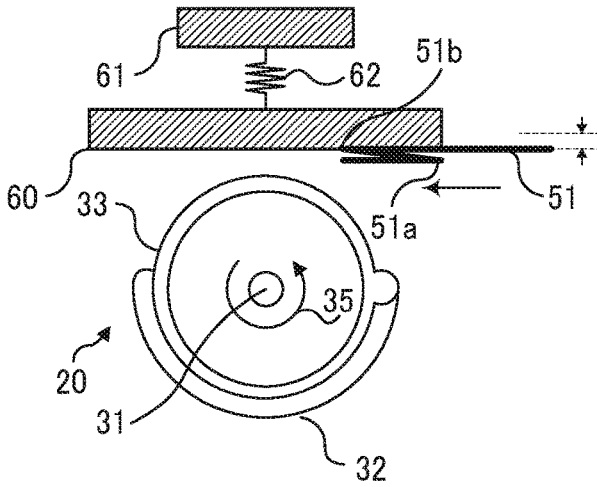
FIGS. 8A and 8B are explanatory diagrams illustrating an additional folding operation done by the additional folding roller.
Figure 8B:
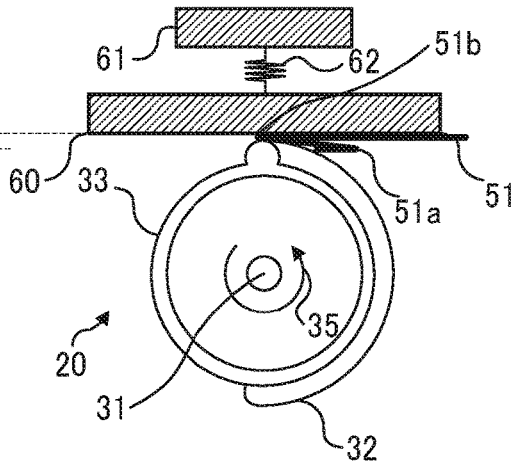

FIGS. 8A and 8B are explanatory diagrams illustrating an additional folding operation done by the additional folding roller. In FIGS. 8A and 8B, the folding apparatus 100 includes a sheet support plate 60, a stationary member 61, and an elastic body 62. The elastic body 62 is attached between the sheet support plate 60 and the stationary member 61 fixed in the folding apparatus 100. The elastic body 62 expands and contracts, that is, elastically deforms, in a direction in which a pressing force from the additional folding roller 20 acts. When the sheet bundle 51 is conveyed from the position illustrated in FIG. 8A to the position illustrated in FIG. 8B and stopped at the position illustrated in FIG. 8B, the additional folding roller 20 rotates in the direction of the arrow 35 in FIG. 8B, that is, counterclockwise in FIG. 8B. As a result, the pressing force transmission portion 32 contacts the sheet bundle 51, pushing up the sheet support plate 60. When the pressing force transmission portion 32 pushes up the sheet support plate 60, the elastic force of the elastic body 62 is applied to the first folded portion 51*a* and the second folded portion 51*b* in the sheet bundle 51, which puts the sharp crease on the first folded portion 51*a* and the second folded portion 51*b*, that is, the additional folding processing is performed.

The elastic body 62 may be an elastic body or an elastic structure capable of applying a desired elastic force, such as a metal spring or a synthetic resin elastic member. In the present embodiment, the sheet support plate 60 is used, but it goes without saying that the effect of the present embodiment can be achieved by a roller instead of the sheet support plate 60.

Figure 9A:
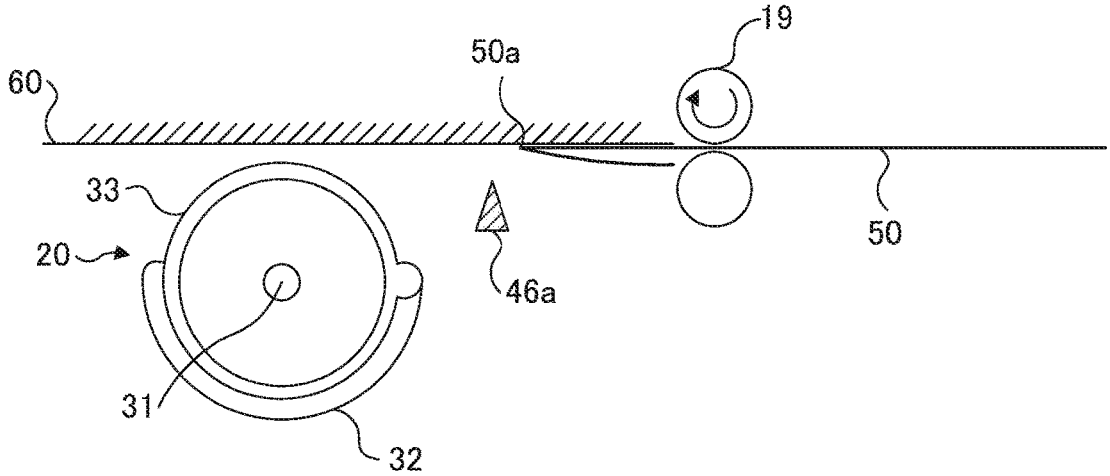
FIGS. 9A to 9E are explanatory diagrams illustrating an additional folding operation.

FIGS. 9A to 9E are explanatory diagrams illustrating an additional folding operation. To describe the additional folding operation, FIG. 9 illustrates a state in which the sixth path 46 illustrated in FIGS. 2 to 4 is rotated to the left by 90 degrees. As illustrated in FIG. 9A, the fourth conveyance roller pair 19 conveys the sheet 50 folded at one position from the right to the left in FIG. 9A toward the additional folding roller 20. This state corresponds to the state illustrated in FIG. 4C.

The additional folding position sensor 46*a* is disposed at a predetermined position on the upstream side from the additional folding roller 20 in the sheet conveyance direction. The additional folding position sensor 46*a* detects a leading end portion 50*a* of the sheet 50 and functions as a leading end detecting sensor. The CPU 410 measures and counts output signals from an encoder that detects a rotation amount of the conveyance motor 407 beginning when the additional folding position sensor 46*a* detects the leading end portion 50*a* of the sheet 50 in the sheet conveyance direction. Based on this measurement, when the CPU 410 determines the leading end portion 50*a* of the sheet 50 reaches a position near the additional folding roller 20, The CPU 410 stops the conveyance motor to stop the fourth conveyance roller pair 19. At the position near the additional folding roller 20, as illustrated in FIG. 9B, the leading end portion 50*a* of the sheet 50 is opposite to the additional folding position, that is, the position where the additional folding roller 20 is closest to the sheet support plate 60 and faces the sheet support plate 60.

Figure 9B:
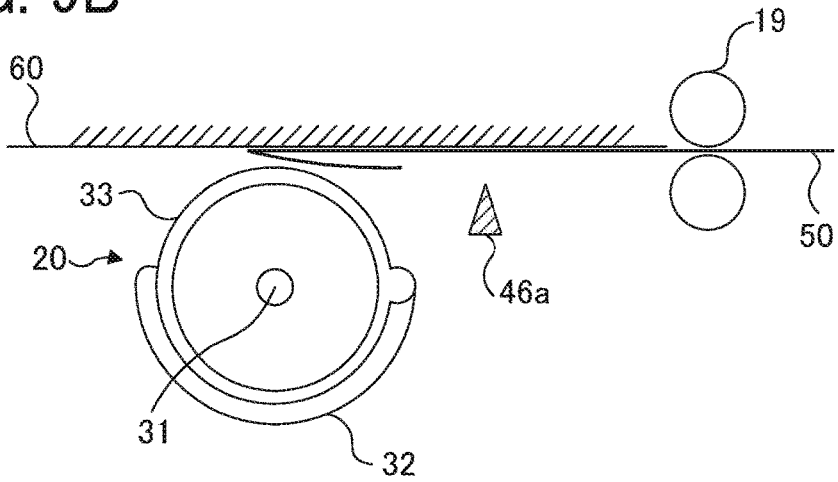
Figure 9C:
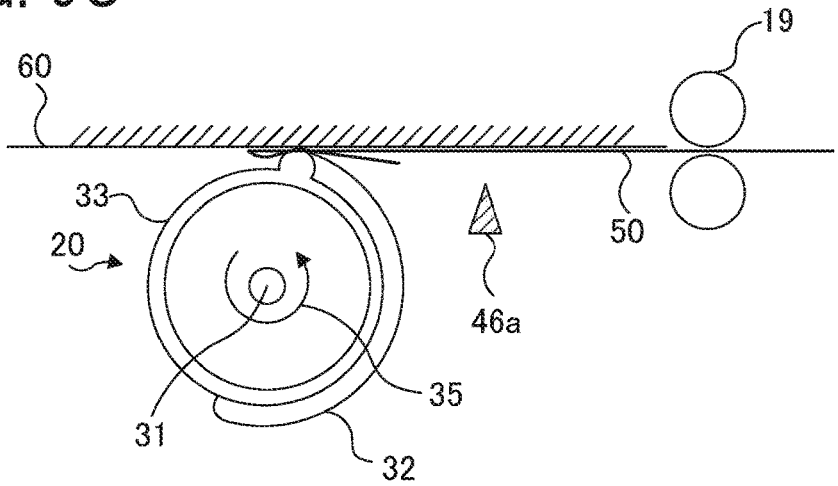

As illustrated in FIG. 9C, the CPU 410 drives the additional folding motor 408 when the leading end portion 50*a* of the sheet 50 stops at the additional folding position illustrated in FIG. 9B. When the additional folding motor 408 starts to be driven, the additional folding roller 20 starts to rotate in the direction of the arrow 35 that is the counterclockwise direction in FIG. 9C, and the pressing force transmission portion 32 contacts the crease of the leading end portion 50*a* of the stopped sheet 50 and start pressing the crease. As a result, the additional folding processing starts for the crease of the leading end portion 50*a* of the sheet 50.

Figure 9D:
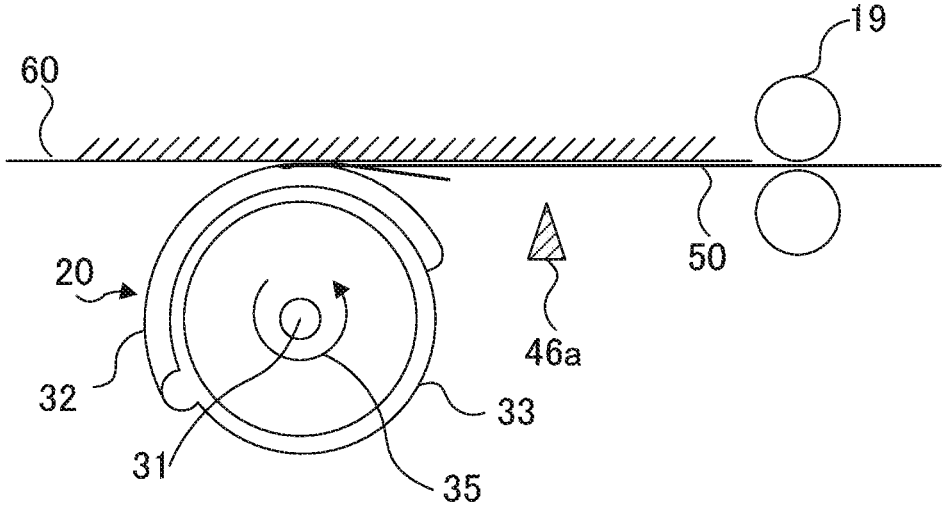
Figure 9E:
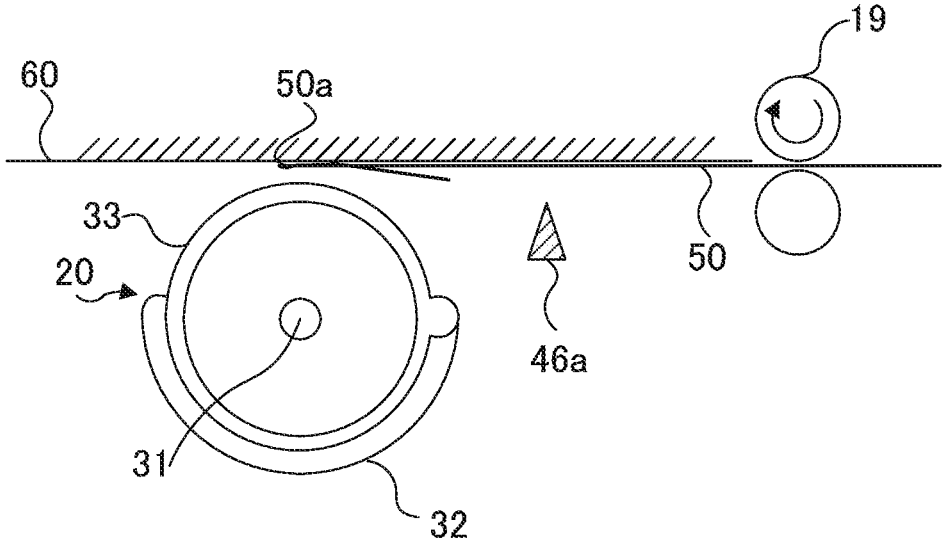

In FIG. 9D, while the additional folding roller 20 further rotates, the pressing force transmission portion 32 pushes the crease of the leading end portion 50*a* of the sheet 50 in order from one end to the other end in the main scanning direction. When the additional folding roller 20 further rotates and the pressing force transmission portion 32 separates from the leading end portion 50*a* of the sheet 50, the additional folding processing is completed from the one end to the other end of the crease. That is, the pressing point of the pressing force transmission portion 32 on the crease moves in the main scanning direction along the crease. Then, as illustrated in FIG. 9E, when the pressing force transmission portion 32 separates from the sheet 50 and the additional folding home position (HP) sensor detects a home position of the additional folding roller 20, the CPU 410 stops the additional folding motor 408 to stop the additional folding roller 20.

The additional folding HP sensor is a sensor to detect the home position at the rotational position of the additional folding roller 20. As described above, pressing the crease starts when the pressing force transmission portion 32 contacts the sheet 50 on the sheet support plate 60 as illustrated in FIG. 9C, and one operation of the additional folding processing ends when the pressing force transmission portion 32 separates from the sheet 50 on the sheet support plate 60.

Figure 10A:
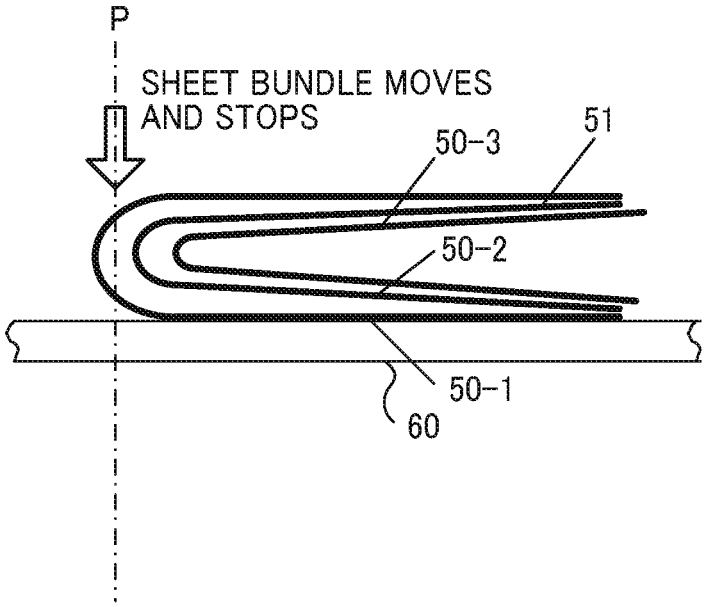
FIGS. 10A and 10B are explanatory diagrams illustrating folded portions in a sheet bundle when one additional folding operation is performed on the folded sheet bundle.
Figure 10B:
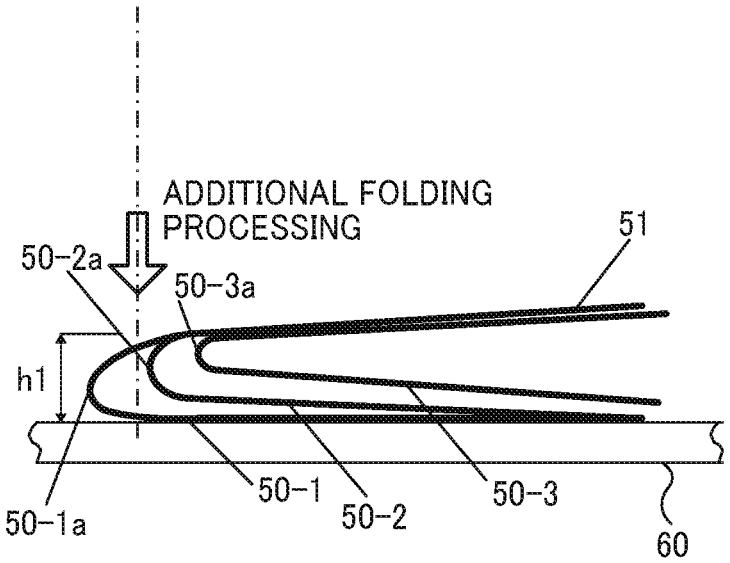

FIGS. 10A and 10B are explanatory diagrams illustrating folded portions in the sheet bundle 51 when one additional folding processing is performed on the folded sheet bundle 51 that is made by overlaying and folding a plurality of sheets. FIGS. 10A and 10B illustrate the state before and after the additional folding roller 20 performs the additional folding processing at the position P on the sheet bundle 51 in which, for example, three sheets 50-1, 50-2, and 50-3 are overlaid and folded. FIG. 10A illustrates the state before the additional folding processing, and FIG. 10B illustrates the state after the additional folding processing. In FIG. 10A, the additional folding roller 20 starts the additional folding processing on the sheet bundle 51 that contacts the sheet support plate 60 and stops as illustrated in FIG. 9B.

At this time, an ironing operation of the pressing force transmission portion 32 by the rotation of the additional folding roller 20 performs the additional folding processing on the folded portion 50-1*a* of the outermost sheet 50-1 in the sheet bundle 51. In the additional folding processing, the sheet 50-1 is ironed and stretched, and as a result, the folding height h1 is reduced. At that time, since the outermost sheet 50-1 expands, positions of a folded portion 50-2*a* of the inner sheet 50-2 and a folded portion 50-3*a* of the inner sheets 50-3 gradually shift to the right side in FIG. 10B relative to the folded portion 50-1*a* of the outermost sheet 50-1. Therefore, expansion amounts of the inner sheets 50-2 and 50-3 by the ironing operation is smaller than that of the outer sheet 50-1, and an effect of the additional folding processing in the sheet bundle 51 is less than the effect of the additional folding processing in one sheet. A state illustrated in FIG. 10A corresponds to a state before the ironing operation of the pressing force transmission portion 32 illustrated in FIG. 9B, and a state illustrated in FIG. 10B corresponds to a state after the ironing operation of the pressing force transmission portion 32 illustrated in FIG. 9C and FIG. 9D.

FIGS. 11A to 11F are explanatory diagrams illustrating change in the folded portion of the sheet bundle 51 when the additional folding processing is performed three times on the folded sheet bundle 51.

Figure 11A:
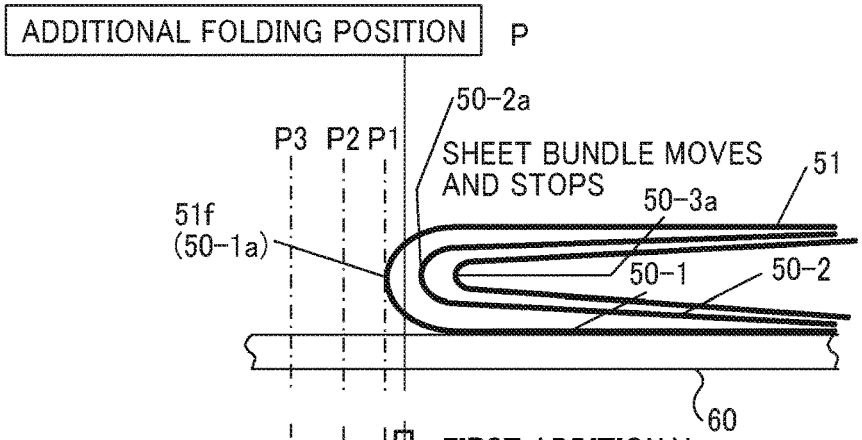
FIGS. 11A to 11F are explanatory diagrams illustrating change in the folded portion of a sheet bundle when a folded sheet bundle is pressed three times.
Figure 11B:
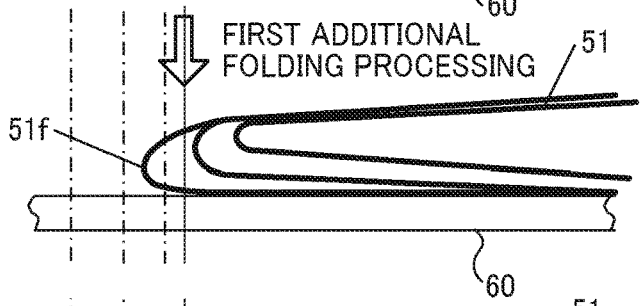
Figure 11C:
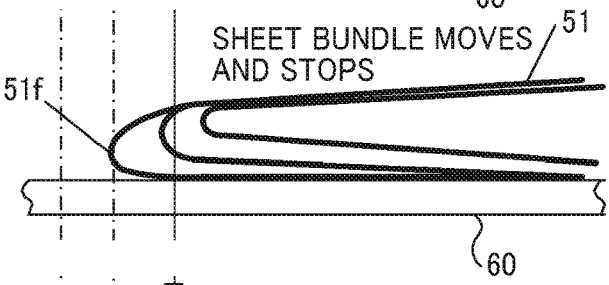

FIGS. 11A and 11B illustrate the first additional folding processing described with reference to FIG. 10. The additional folding position is illustrated as P in FIGS. 11A to 11F. After the first additional folding processing, to change a position of the sheet bundle 51 relative to the additional folding roller 20, the fourth conveyance roller pair 19 conveys the sheet bundle 51 such that the position of the leading edge 51*f* of the folded portion 50-1*a* of the sheet bundle 51 moves from a position P1 to a position P2 in FIG. 11C and stops the sheet bundle 51 at the position P2 illustrated in FIG. 11C. A conveyance control of the sheet bundle 51 is as described with reference to FIG. 9.

Figure 11D:
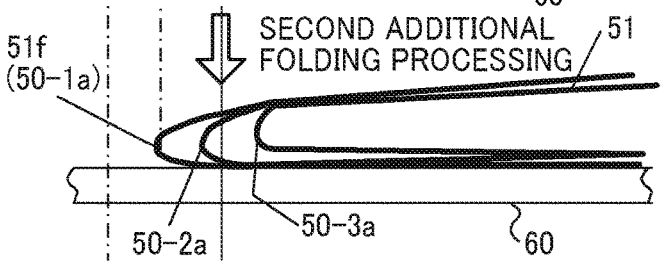

FIG. 11D illustrates a state after the second additional folding processing which is performed when the leading edge 51*f* of the folded portion 50-1*a* of the sheet bundle 51 is at the position P2. In the state illustrated in FIG. 11D, the additional folding processing at a position close to the folded portion 50-2*a* of the sheet 50-2 on the inner side of the sheet bundle 51 gives a better effect of the additional folding processing. This is understood from the fact that the height of the folded portion of the sheet bundle 51 in FIG. 11D is lower than that in FIG. 11B.

Figure 11E:
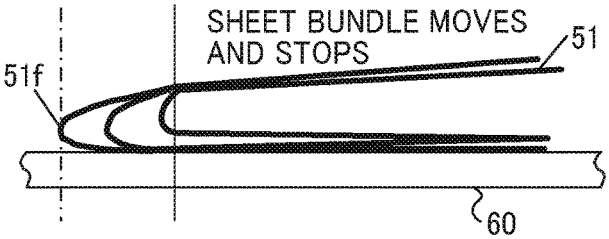
Figure 11F:
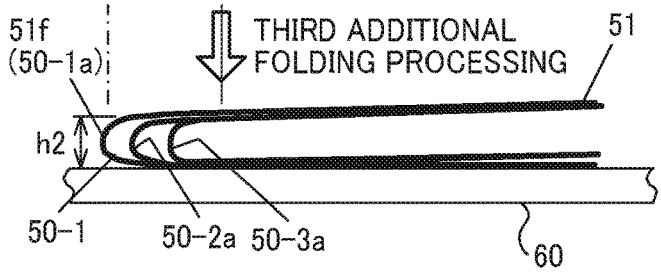

After the second additional folding processing, the fourth conveyance roller pair 19 slightly conveys the sheet bundle 51 such that the position of the leading edge 51*f* of the sheet bundle 51 moves from the position P2 to a position P3 in FIG. 11E and stops the sheet bundle 51 at the position P3 illustrated in FIG. 11E. The third additional folding processing at the position P3 illustrated in FIG. 11E results in a state of the sheet bundle 51 illustrated in FIG. 11F. When the additional folding processing is performed three times in this way, the additional folding processing is performed at the additional folding position P where the effect is exerted on the innermost sheet 50-3. As a result, the height of the folded portion of the sheet bundle 51 is reduced. The height h2 of the folded portion illustrated in FIG. 11F after the three times of the additional folding processing is lower than the height h1 of the folded portion illustrated in FIG. 10B after one additional folding processing, that is, h1>h2.

FIGS. 11A to 11F illustrate an example of the three times of the additional folding processing for the sheet bundle 51 of three folded sheets, but the position of the additional folding roller 20 relative to the sheet bundle 51 and number of times of the additional folding processing performed by the additional folding roller 20 are not necessarily proportional to the number of sheets. The control circuitry 400 may determine the number of positions on the sheet bundle 51 where the additional folding processing is performed based on the threshold of the sheet number. For example, the control circuitry 400 may perform the additional folding processing at n positions on the sheet bundle 51 when the number of sheets is up to X and at m positions on the sheet bundle 51 when the number of sheets is from X to Y. In other words, the number of times of the additional folding processing may be set according to the number of sheets of the sheet bundle 51.

In the present embodiment, a position of the additional folding roller 20 is fixed, and the fourth conveyance roller pair 19 changes the position of the sheet bundle 51. This change of the relative position between the sheet bundle 51 and the additional folding roller 20 changes a position of the sheet bundle 51 on which the additional folding processing is performed.

Second Embodiment

In the first embodiment, as described with reference to FIGS. 8 to 11, the movement of the sheet 50 or the sheet bundle 51 with respect to the additional folding roller 20 changes the position of the additional folding processing. By contrast, in a second embodiment, movement of the additional folding roller 20 with respect to the sheet 50 or the sheet bundle 51 may change the position of the additional folding processing, as described below.

Figure 12A:
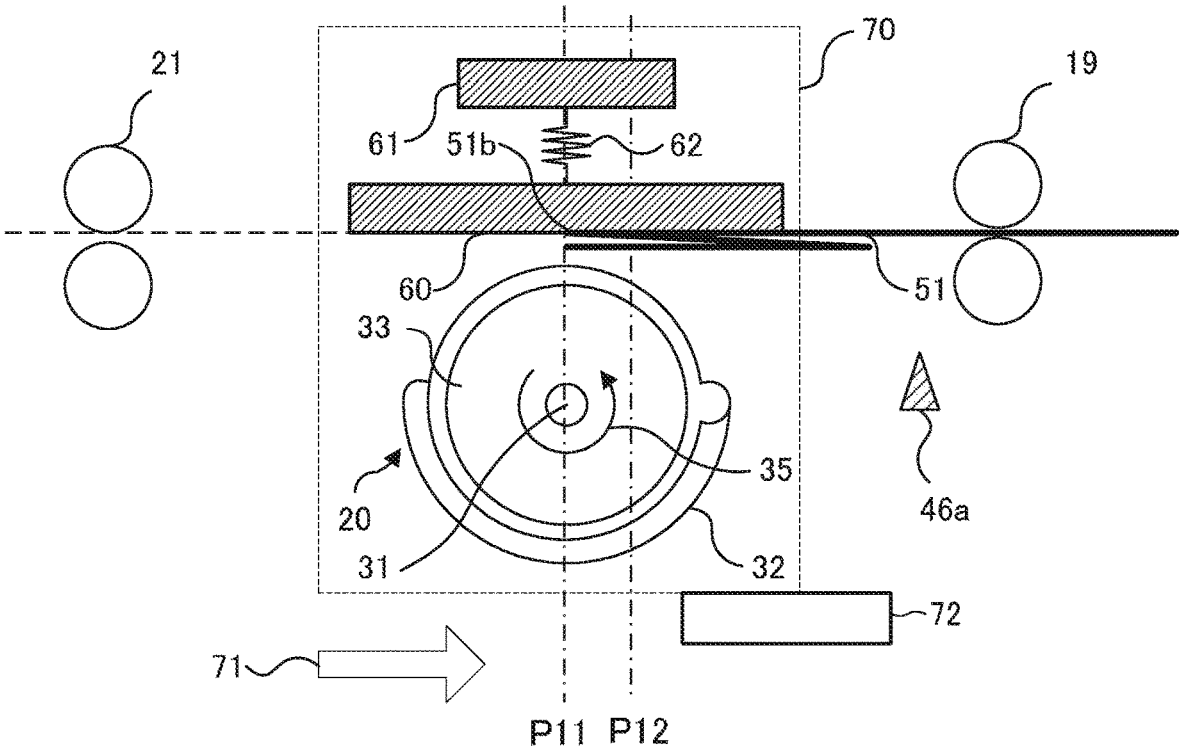
FIGS. 12A and 12B are explanatory diagrams illustrating an operation when the additional folding roller in the folding apparatus according to a second embodiment moves to change an additional folding position.
Figure 12B:
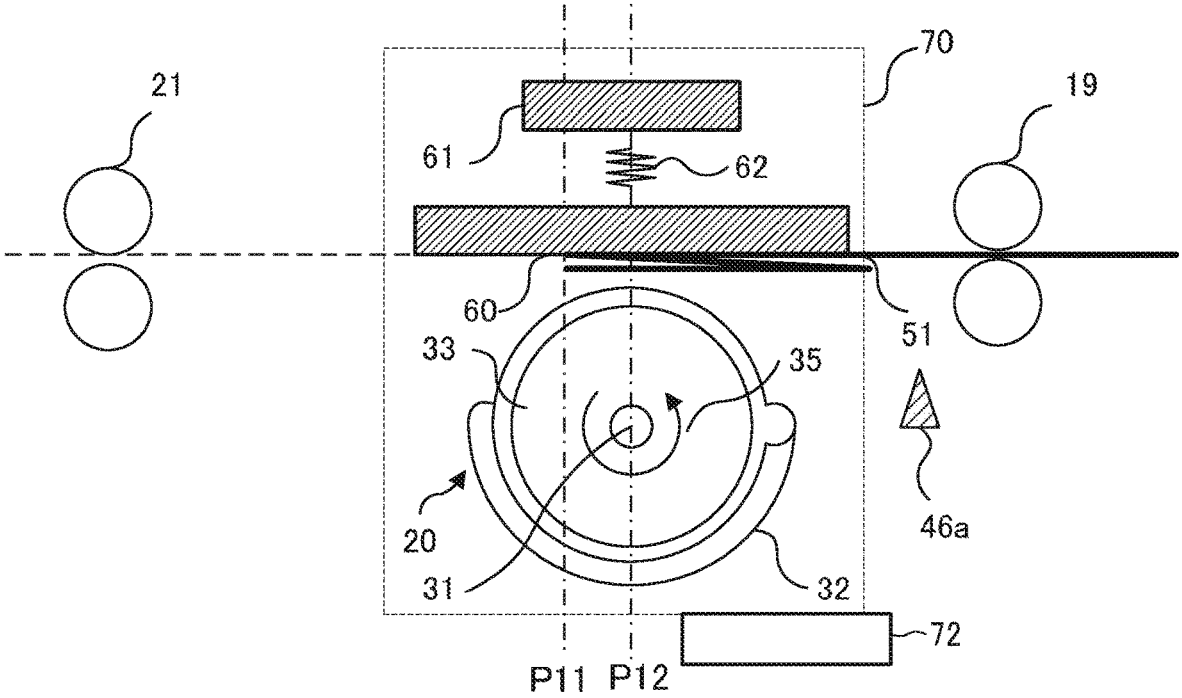
Figure 13A:
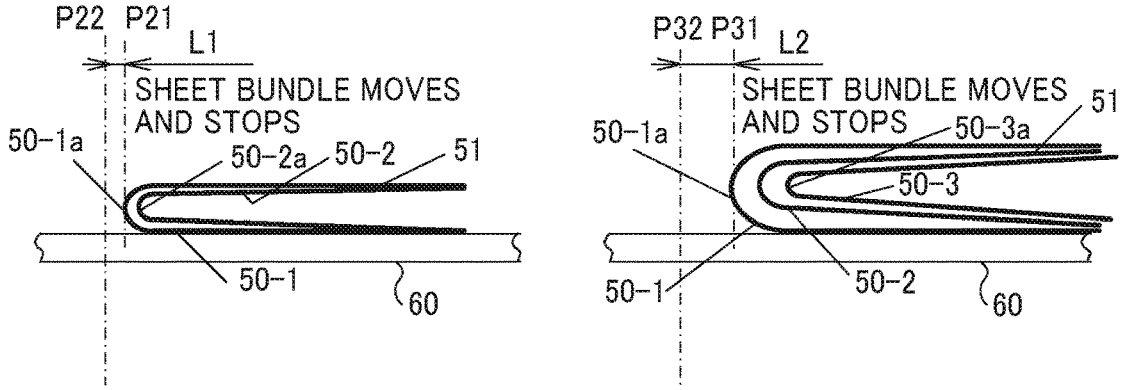
FIGS. 13A to 13D are explanatory diagrams illustrating change in the folded portion of the sheet bundle when the folding apparatus according to a third embodiment changes the additional folding position in sheet bundles of two folded sheets and three folded sheets.
Figure 13B:
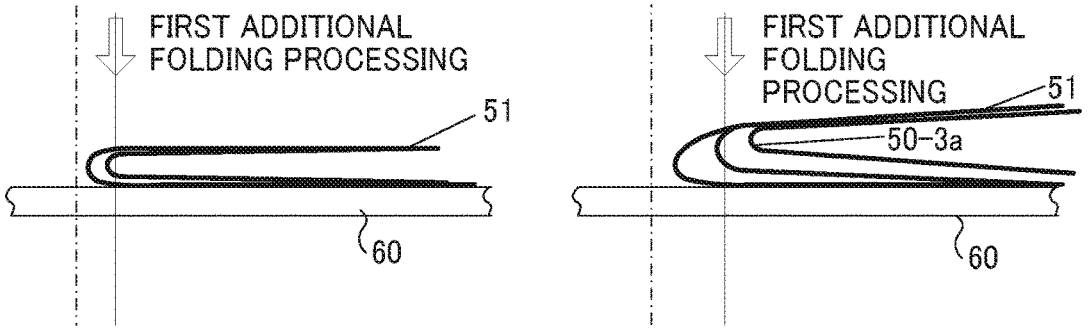
Figure 13C:
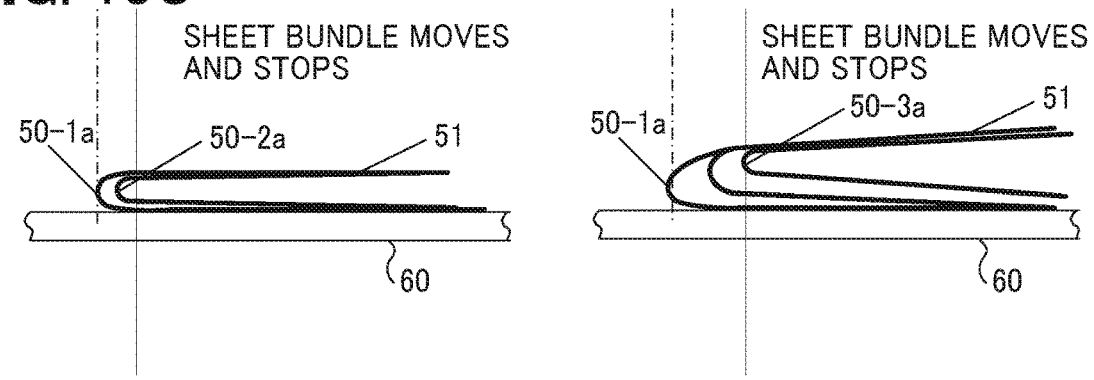
Figure 13D:
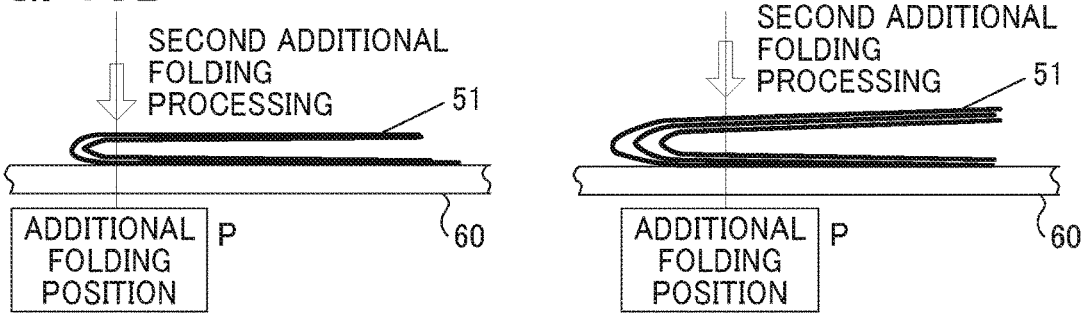
Figure 14A:
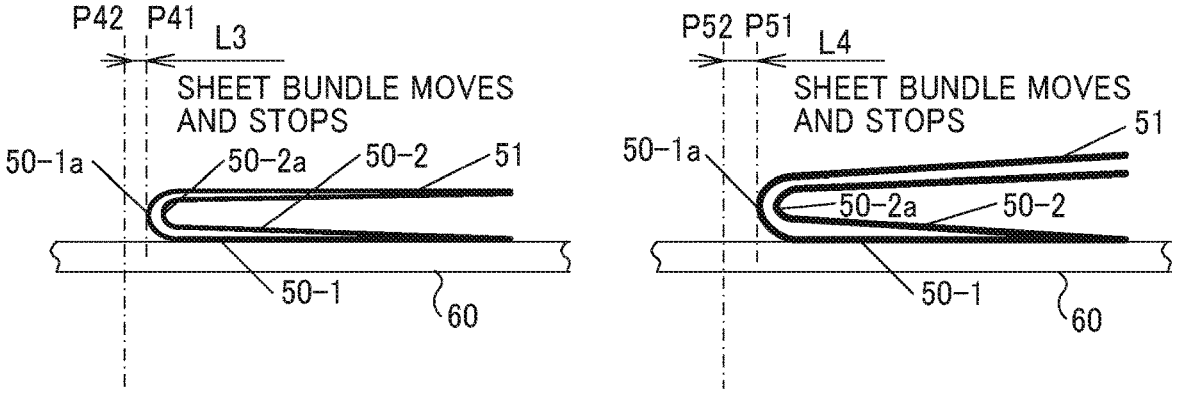
FIGS. 14A to 14D are explanatory diagrams illustrating change in the folded portion of the sheet bundle when the folding apparatus according to a fourth embodiment presses a thick sheet bundle and a thin sheet bundle twice.
Figure 14B:
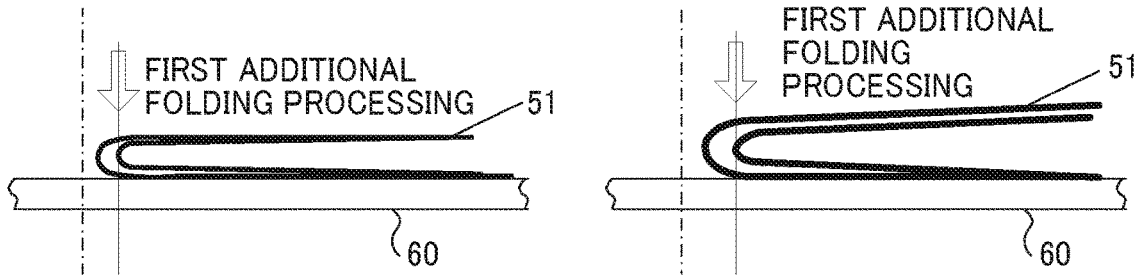
Figure 14C:
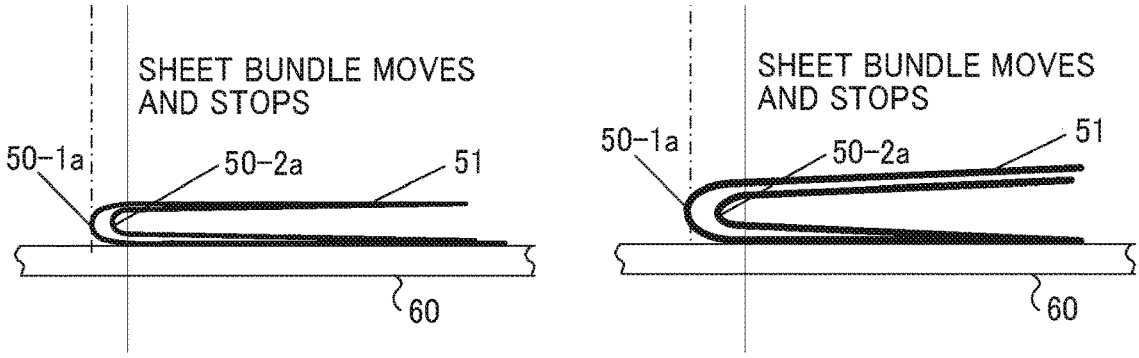
Figure 14D:
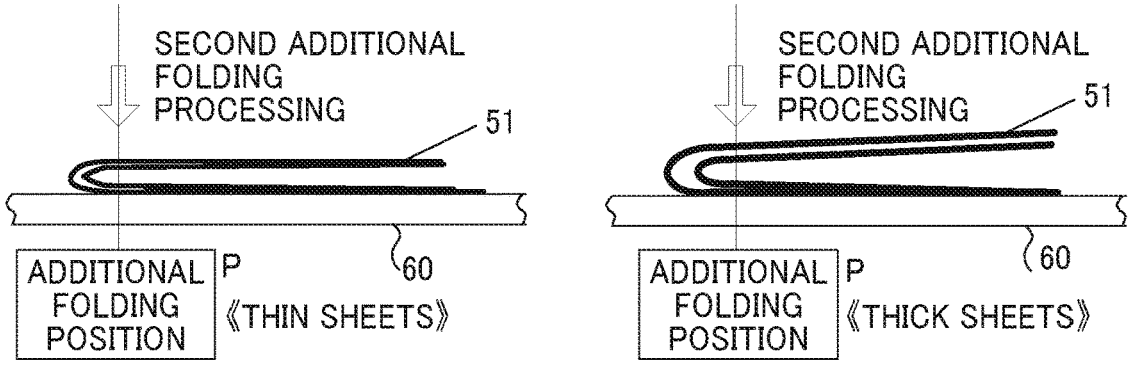

FIGS. 12A and 12B are explanatory diagrams illustrating an operation when the additional folding roller 20 in the folding apparatus 100 according to the second embodiment moves to change the additional folding position. The following describes a configuration of the folding apparatus 100 according to the second embodiment that is different from the configuration of the folding apparatus 100 according to the first embodiment described above. Thus, a description of the basic configuration of the folding apparatus 100 that is equivalent to the configuration of the folding apparatus is omitted.

The folding apparatus according to the second embodiment includes one additional folding unit 70 including the additional folding roller 20, the sheet support plate 60, the stationary member 61, and the elastic body 62. The folding apparatus according to the second embodiment also includes an additional folding unit moving device 72 including a motor to move the additional folding unit 70 in the sheet conveyance direction. In FIG. 12A, the additional folding position is a position P11 of a crease of the second folded portion 51*b* of the Z-folded sheet bundle 51. On the other hand, in FIG. 12B, the additional folding unit moving device 72 moves the additional folding position to a position P12 on the upstream side in the sheet conveyance direction, that is, a direction of an arrow 71, and the additional folding roller 20 performs the additional folding processing at the position P12. A number of times of the additional folding processing is appropriately set according to the characteristics of the sheet bundle 51 to be subjected to the additional folding processing.

In the present embodiment, after the additional folding roller 20 moves the position P12 different from the previous additional folding position P11 with respect to the sheet bundle 51 that is stopped, the additional folding roller 20 performs the additional folding processing again at the position P12. That is, in the present embodiment, the additional folding roller 20 relatively moves between the additional folding positions P11 and P12 with respect to the sheet bundle 51.

Since other parts except for the additional folding unit moving device 72 are configured in the same manner as in the first embodiment and work in the same manner, duplicate explanation is omitted.

Third Embodiment

When productivity requested for the image forming system 1 limits a number of times of the additional folding processing, changing the position at which the additional folding processing is performed based on the number of sheets in the sheet bundle is highly effective in reducing the height of the folded portion. FIGS. 13A to 13D are explanatory diagrams illustrating change in the folded portion of the sheet bundle 51 when the folding apparatus 100 according to a third embodiment changes the additional folding position in sheet bundles of two folded sheets and three folded sheets. Here, the number of additional folding is set to 2 times.

As can be seen by comparing the drawing on the left side in FIG. 13 that illustrates two folded sheets and the drawing on the right side in FIG. 13 that illustrates three folded sheets, as the number of sheets increases, the position of the folded portion 50-3*a* of the folded inner sheet 50-3 shifts to the right in FIG. 13. Therefore, the additional folding position P for the second operation of the additional folding processing on the three folded sheets is preferably set right side from the additional folding position for the second operation of the additional folding processing on the two folded sheets. In FIG. 13, assuming that the positions of the leading edge of the sheet bundle 51 including the two folded sheets when the additional folding processing is performed two times are positions P21 and P22, and assuming that the positions of the leading edge of the sheet bundle 51 including the three folded sheets when the additional folding processing is performed two times are positions P31 and P32, the movement amount L1 (|P21−P22|) of the sheet bundle including the two folded sheets is smaller than the movement amount L2 (|P31−P32|) of the sheet bundle 51 including the three folded sheets, that is, L1<L2. The optimum values of the movement amounts L1 and L2 are determined experimentally. In the present embodiment, preferably L1=1 mm, L2=2 mm.

In the present embodiment, it is sufficient for each of the additional folding positions P to be relatively different between the additional folding roller 20 and the sheet bundle 51. The movement amounts L1 and L2 can be arbitrarily set or changed to desired values by the positions of the sheet bundle 51 controlled by the conveyance control of the sheet bundle 51 in the first embodiment, the distances of the additional folding roller 20 controlled by the movement control of the additional folding unit 70 including the additional folding roller 20 in the second embodiment, or by a combination of the positions and the distances described above. Since other parts which are not described above are configured in the same manner as in the first and second embodiments and work in the same manner, duplicate explanation is omitted.

Fourth Embodiment

When the number of times of additional folding processing is limited, changing the additional folding position based on the thickness of the sheet 50 is highly effective in reducing the height of the folded portion. FIGS. 14A to 14D is an explanatory diagram illustrating changes of the folded portions of the sheet bundles of thick sheets and thin sheets while the additional folding processing is performed twice in the folding apparatus 100 according to the fourth embodiment.

As can be seen by comparing the drawing on the left side in FIGS. 14A to 14D that illustrates the additional folding processing for thin sheets and the drawing on the right side in FIGS. 14A to 14D that illustrates the additional folding processing for thick sheets, the position of the folded portion 50-2*a* of the folded inner thick sheet 50-2 with respect to the folded portion 50-1*a* of the folded outer thick sheet 50-1 is on the right side of the position of the folded portion 50-2*a* of the folded inner thin sheet 50-2 with respect to the folded portion 50-1*a* of the folded outer thin sheet 50-1. Therefore, preferably, the second additional folding position P for the thick sheets is set on the right side (inside) of the second additional folding position P for the thin sheets. In FIGS. 14A to 14D, assuming that the positions of the leading edge of the sheet bundle 51 including the thin sheets when the additional folding processing is performed two times are positions P41 and P42, and assuming that the positions of the leading edge of the sheet bundle 51 including the thick sheets when the additional folding processing is performed two times are positions P51 and P52, the movement amount L3 (|P41−P42|) of the sheet bundle including the thin sheets is smaller than the movement amount L4 (|P51−P52|) of the sheet bundle 51 including the thick sheets, that is, L3<L4. The optimum values of the movement amounts L3 and L4 are determined experimentally, and, in the present embodiment, preferably, L3=1 mm (for the thin sheet which is less than 50 g/m2), L4=2 mm (for the thick sheet which is equal to or greater than 50 g/m2).

Thickness data of the sheet 50 is transmitted from the image forming apparatus 200 to the control circuitry 400 via the communication interface 409 and stored in the RAM 402 by the control of the CPU 410. The CPU sets the movement amounts L3 and L4 to change the additional folding position P with respect to the sheet bundle 51 based on the thickness data of the sheet 50 stored in the RAM 402. In the present embodiment, it is sufficient for each of the additional folding positions P to be relatively different between the additional folding roller 20 and the sheet bundle 51. The movement amounts L3 and L4 can be arbitrarily set or changed to desired values by the positions of the sheet bundle 51 controlled by the conveyance control of the sheet bundle 51 in the first embodiment, the distances of the additional folding roller 20 controlled by the movement control of the additional folding unit 70 including the additional folding roller 20 in the second embodiment, or by a combination of the positions and the distances described above.

Since other parts not described above are configured in the same manner as in the first and second embodiments and work in the same manner, duplicate explanation is omitted. In the fourth embodiment, when the number of sheets 50 is different, the movement amounts L3 and L4 may be set in combination with the third embodiment.

As described above, various aspects of the present disclosure can achieve the following effects.

In a first aspect, a folding apparatus such as the folding apparatus 100 includes a folding device such as the first folding roller pair 17*a* and the second folding roller pair 17*b* to fold the sheet bundle such as the plurality of overlaid sheets 50; an additional folding device including a pressure roller such as the additional folding roller 20 disposed downstream from the folding device in the sheet conveyance direction and configured to rotate along the sheet conveyance direction to press the sheet bundle 51 after the folding device folds the sheet bundle and a sheet support member such as the sheet support plate 60 disposed opposite the pressure roller via the sheet bundle; a conveyer such as the fourth conveyance roller pair 19 to convey the sheet bundle to a position such as the additional folding position P at which the additional folding device presses the sheet bundle and holds the sheet bundle at the position; and the control circuitry 400 that causes the additional folding device to perform the additional folding processing on a first position such as the additional folding position P1 of the sheet bundle, the conveyer to move the sheet bundle to a second position such as the position P2 different from the first position, and the additional folding device to perform the additional folding processing at the second position again. In the first aspect, the folding apparatus configuration is not changed, the sheet bundle 51 is moved to change the additional folding position, and the additional folding processing corresponding to a change of the additional folding position of the inner sheet 50 in the sheet bundle 51 can be performed. As a result, the folding height of the sheet bundle 51 can be reduced.

The second position different from the first position means that the position P2 of the folded portion of the sheet bundle 51 at which the second additional folding processing is performed is different from the position P1 of the folded portion of the sheet bundle 51 at which the first additional folding processing is performed.

In a second aspect, the control circuitry such as the control circuitry 400 in the folding apparatus 100 according to the first aspect causes the conveyer such as the fourth conveyance roller pair 19 to stop the sheet bundle at the second position such as the point P2 and the additional folding device to perform additional folding processing at the second position again. In the second aspect, the folding apparatus configuration is not changed, the sheet bundle 51 is moved to change the additional folding position, and the additional folding processing corresponding to a change of the additional folding position of the inner sheet 50 in the sheet bundle 51 can be performed. As a result, the folding height of the sheet bundle 51 can be reduced.

In a third aspect, the folding apparatus such as the folding apparatus 100 according to the first aspect includes a moving device such as the additional folding unit moving device 72 to move the additional folding device, and the control circuitry such as the control circuitry 400 causes the moving device to move the additional folding device to the second position such as the position P12 different from the additional folding position P11 in FIG. 12 and the additional folding device to perform the additional folding processing at the second position again. In the third aspect, a movement control of the additional folding unit including the additional folding roller can reduce the folding height of the sheet bundle 51.

In a fourth aspect, the control circuitry such as the control circuitry 400 of the folding apparatus 100 according to the first aspect sets a number of times of the additional folding processing based on a number of sheets of the sheet bundle. For example, the control circuitry 400 performs the additional folding processing at n positions on the sheet bundle 51 when the number of sheets is up to X and at m positions on the sheet bundle 51 when the number of sheets is from X to Y. In the fourth aspect, the folding apparatus configuration is not changed, and setting the number of times of the additional folding processing by the additional folding roller 20 contributes to reducing the folding height of the sheet bundle 51.

In a fifth aspect, the control circuitry such as the control circuitry 400 of the folding apparatus 100 according to the first aspect sets a distance between the first position and the second position based on a number of sheets of the sheet bundle. For example, the control circuitry 400 sets the movement amounts L1 and L2 in FIG. 13 that are movement amounts of the sheet bundle 51 until the second additional folding processing is performed after the first additional folding processing, which mean the distance between the first position such as the positions P21 and P31 and the second position such as the positions P22 and P32. In the fifth aspect, the folding apparatus configuration is not changed, and setting the distance between the first position and the second position contributes to reducing the folding height of the sheet bundle 51 regardless of the number of sheets.

In a sixth aspect, the control circuitry such as the control circuitry 400 of the folding apparatus 100 according to the first aspect sets a distance between the first position and the second position based on a thickness of the sheet 50. For example, the control circuitry 400 sets the movement amounts L3 and L4 in FIGS. 14A to 14D that are movement amounts of the sheet bundle 51 until the second additional folding processing is performed after the first additional folding processing, which mean the distance between the first position such as the positions P41 and P51 and the second position such as the positions P42 and P52. In the sixth aspect, the folding apparatus configuration is not changed, and setting the distance between the first position and the second position contributes to reducing the folding height of the sheet bundle regardless of the sheet thickness.

In a seventh aspect, an image forming system such as the image forming system 1 includes the folding apparatus such as the folding apparatus 100 according to the first aspect. In the seventh aspect, the image forming system configuration is not changed, and the image forming system can reduce the folding height of the sheet bundle in which images are formed.

It is to be noted that the above embodiments are presented as examples to realize the present disclosure, and it is not intended to limit the scope of the disclosure. These novel embodiments can be implemented in various other forms, and various omissions, substitutions, and changes can be made without departing from the gist of the disclosure. These embodiments and variations are included in the scope and gist of the disclosure and are included in the disclosure described in the claims and the equivalent scope thereof.

The embodiment and variations described above are preferred example embodiments of the present disclosure, and various applications and variations may be made without departing from the scope of the present disclosure. For example, elements and/or features of different illustrative embodiments may be combined with each other and/or substituted for each other within the scope of the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits. A processing circuit includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A folding apparatus comprising:

a folding device configured to fold a sheet bundle;

an additional folding device including, a pressure roller disposed downstream from the folding device in a sheet conveyance direction and configured to rotate along the sheet conveyance direction to press the sheet bundle after the folding device folds the sheet bundle, and a sheet support member disposed opposite the pressure roller via the sheet bundle;

a conveyer configured to convey the sheet bundle to a position at which the additional folding device presses the sheet bundle and hold the sheet bundle at the position; and control circuitry configured to, instruct the additional folding device to perform additional folding processing at a first position on the sheet bundle, set a distance between the first position and a second position different from the first position based on at least one of a number of sheets in the sheet bundle and a thickness of a sheet in the sheet bundle, instruct the conveyer to move the sheet bundle to the second position, and instruct the additional folding device to perform the additional folding processing at the second position on the sheet bundle.

2. The folding apparatus according to claim 1, wherein the control circuitry sets a number of times of the additional folding processing based on at least one of the number of sheets of the sheet bundle and the thickness of the sheet in the sheet bundle.

3. The folding apparatus according to claim 1, wherein the control circuitry sets the distance between the first position and the second position based on at least one of the number of sheets in the sheet bundle and the thickness of the sheet in the sheet bundle.

4. An image forming system configured to form an image on a sheet, the image forming system comprising:

the folding apparatus according to claim 1 configured to fold the sheet on which the image is formed.

5. A folding apparatus comprising:

a folding device configured to fold a sheet bundle;

an additional folding device including, a pressure roller disposed downstream from the folding device in a sheet conveyance direction and configured to rotate along the sheet conveyance direction to press the sheet bundle after the folding device folds the sheet bundle, and a sheet support member disposed opposite the pressure roller via the sheet bundle;

a conveyer configured to convey the sheet bundle to a position at which the additional folding device presses the sheet bundle and hold the sheet bundle at the position;

a moving device configured to move the additional folding device; and control circuitry configured to cause:

the additional folding device to perform additional folding processing at a first position on the sheet bundle, the moving device to move the additional folding device to a second position different from the first position, and the additional folding device to perform the additional folding processing at the second position on the sheet bundle.

6. The folding apparatus according to claim 5, wherein the control circuitry sets a number of times of the additional folding processing based on at least one of a number of sheets in the sheet bundle and a thickness of a sheet in the sheet bundle.

7. The folding apparatus according to claim 5, wherein the control circuitry sets a distance between the first position and the second position based on at least one of a number of sheets in the sheet bundle and a thickness of a sheet in the sheet bundle.

8. An image forming system configured to form an image on a sheet, the image forming system comprising:

the folding apparatus according to claim 5 configured to fold the sheet on which the image is formed.

9. A folding apparatus comprising:

a folding device configured to fold a sheet bundle;

an additional folding device including, a pressure roller disposed downstream from the folding device in a sheet conveyance direction and configured to rotate along the sheet conveyance direction to press the sheet bundle after the folding device folds the sheet bundle, and a sheet support member disposed opposite the pressure roller via the sheet bundle;

a conveyer configured to convey the sheet bundle to a position at which the additional folding device presses the sheet bundle and hold the sheet bundle at the position;

a moving device configured to move the additional folding device; and control circuitry configured to, set a number of times of an additional folding processing based on at least one of a number of sheets in the sheet bundle and a thickness of a sheet in the sheet bundle, and perform the additional folding processing the number of times by instructing the conveyer to move the sheet bundle to different positions the number of times, and performing the additional folding processing at each of the different positions on the sheet bundle before moving the sheet bundle to a next one of the different positions.

10. An image forming system configured to form an image on a sheet, the image forming system comprising:

the folding apparatus according to claim 9 configured to fold the sheet on which the image is formed.

* * * * *